US008044318B2

(12) United States Patent
Dufournet et al.

(10) Patent No.: US 8,044,318 B2
(45) Date of Patent: Oct. 25, 2011

(54) INTERRUPTING CHAMBER OF A CIRCUIT-BREAKER HAVING TWO COMPRESSION VOLUMES

(75) Inventors: Denis Dufournet, Sathonay-Camp (FR); Dan Penache, Chavanoz (FR); Michel Tresy, Chassieu (FR); Michel Perret, Tramolé (FR)

(73) Assignee: Areva T&D SA, Paris (FR)

( * ) Notice: Subject to any disclaimer, the term of this patent is extended or adjusted under 35 U.S.C. 154(b) by 606 days.

(21) Appl. No.: 12/244,711

(22) Filed: Oct. 2, 2008

(65) Prior Publication Data

US 2009/0090697 A1 Apr. 9, 2009

(30) Foreign Application Priority Data

Oct. 3, 2007 (FR) ..... 07 06923

(51) Int. Cl.
*H01H 33/70* (2006.01)

(52) U.S. Cl. ..... 218/46; 218/43

(58) Field of Classification Search ..... 218/43–47, 218/61, 68, 76, 78–82, 7, 12, 13, 14, 154–156
See application file for complete search history.

(56) References Cited

U.S. PATENT DOCUMENTS

| | | | | |
|---|---|---|---|---|
| 3,975,602 | A | 8/1976 | Hertz et al. | |
| 4,440,997 | A | 4/1984 | Garzon | |
| 4,559,425 | A | 12/1985 | Kirchesch et al. | |
| 4,665,289 | A | 5/1987 | Yanabu et al. | |
| 4,945,197 | A * | 7/1990 | Thuries et al. | 218/62 |
| 4,992,634 | A * | 2/1991 | Thuries et al. | 218/43 |
| 5,859,399 | A * | 1/1999 | Perret | 218/60 |
| 5,977,502 | A | 11/1999 | Mizoguchi et al. | |
| 6,018,133 | A | 1/2000 | Thuries | |
| 2008/0290069 | A1 | 11/2008 | Dufournet et al. | |

FOREIGN PATENT DOCUMENTS

| | | |
|---|---|---|
| CH | 645 754 | 10/1984 |
| EP | 0 201 430 | 12/1986 |
| EP | 0 591 039 | 4/1994 |
| EP | 0 807 946 | 11/1997 |
| EP | 0 821 382 | 1/1998 |
| EP | 0 897 185 | 2/1999 |
| EP | 0 933 795 | 8/1999 |
| FR | 2 892 851 | 5/2007 |

OTHER PUBLICATIONS

Preliminary Search Report for French Application No. 07 06923 mailed Apr. 3, 2008.

* cited by examiner

*Primary Examiner* — Renee S Luebke
*Assistant Examiner* — Marina Fishman
(74) *Attorney, Agent, or Firm* — Nixon Peabody LLP

(57) ABSTRACT

A current interrupting chamber comprising a moving assembly movable axially between a start position and an end position of an operation of opening the circuit-breaker. The current interrupting chamber includes a first compression chamber; a hollow drive tube having ports for bringing the interior of the drive tube into communication with the outside of the current interrupting chamber; a second compression chamber; and a structure for obstructing the ports of the drive tube from the start position of an operation of opening the circuit-breaker and up to an intermediate position which is reached between the position of separation of two arcing contacts from each other and the end position of an operation of opening the circuit-breaker.

13 Claims, 6 Drawing Sheets

INTERRUPTING CHAMBER OF A CIRCUIT-BREAKER HAVING TWO COMPRESSION VOLUMES

CROSS REFERENCE TO RELATED APPLICATIONS OR PRIORITY CLAIM

This application claims priority to French Patent Application No. 07 06923, filed Oct. 3, 2007.

DESCRIPTION

1. Technical Field

This document relates to the field of interrupting chambers for power circuit-breakers, and more particularly to that of interrupting chambers with two compression volumes. This interrupting chamber is particularly well adapted for high voltage use, particularly at voltages greater than or equal to about 72.5 kilovolts (kV).

2. Current State of the Prior Art

In the field of circuit-breakers, and in particular that of power circuit-breakers, it is important to expend as little operating energy as possible for breaking currents, whether these are fault currents, for example in a short circuit, or load currents such as unloaded line currents. The documents U.S. Pat. No. 4,559,425 and U.S. Pat. No. 3,975,602 describe circuit-breakers with automatic blow-out in which a dielectric gas is compressed so as to permit blow-out of an arc that forms between the arcing contacts during a current-interrupting operation, or an operation of opening the circuit-breaker. The compression is in general achieved by means of a drive member that acts on a moving part, such as a piston, in the interrupting chamber. Those circuit-breakers also make use of the energy supplied by the arc in the form of heat, thereby reducing the consumption of energy drawn from outside as compared with conventional gas-compression circuit-breakers. In a circuit-breaker of that kind, the stroke of the moving part in the interrupting chamber, effecting compression, is in approximate proportion to the nominal voltage of the circuit-breaker. The higher the nominal voltage, in particular when this voltage is greater than about 245 kV, the longer the stroke needed, and this increases the energy needed by the circuit-breaker to break the current.

However, in order to break high currents, that is to say currents of value that is higher than about 30% of the value of the breaking power assigned to the circuit-breaker, it is not necessary to compress the gas during the whole of the operation of opening the circuit-breaker, because the energy supplied by the arc is enough to blow out the arc and to interrupt it, without the compression stroke being fully effected. The documents EP 0 897 185 and EP 0 591 039 describe circuit-breakers with automatic blow-out and with a reduced compression stroke. Those circuit-breakers perform compression of the gas only over part of the stroke. However, where the current is low, being for example less than or equal to about 30% of the value of the breaking power, the energy supplied by the arc is much smaller than where the current is high, and if in addition the arcing time is long (in the range about 13 milliseconds (ms) to about 20 ms), there is a risk that the gas blast will be insufficient to ensure interruption of the current.

The document FR 2 892 851 describes a current interrupting chamber for a circuit-breaker that includes two compression chambers that cooperate with each other during an operation of opening the circuit-breaker. The second compression chamber injects dielectric fluid into the first compression chamber during part of the operation of opening the circuit-breaker, when the pressure in the first compression chamber is lower than the pressure in the second compression chamber.

In that particular current interrupting chamber, the cooperation between the two compression chambers during an operation of breaking a high current, serves to conserve the advantages of a reduced compression stroke, performed by the first compression chamber, while during an operation of breaking a low current, it carries out the breaking operation without pointlessly increasing consumption of energy from outside, whatever the arcing time may be, and in particular when the arcing time is long.

There also exist currents, referred to as capacitive currents, that can appear when the power line connected to the circuit-breaker is open at one end, or when power exchange adjusting capacitors are connected to the power network. Breaking those currents, e.g. of value lower than 500 amperes (A), is an operation that most circuit-breakers have to carry out. Such breaking of capacitive currents is achieved if the voltage across the circuit-breaker is higher than the restored voltage imposed by the power network.

However, an electrical breakdown may occur at the circuit-breaker, in particular between the arcing contacts of the circuit-breaker, in the course of the operation of breaking capacitive currents, if the dielectric strength between contacts is lower than the restored voltage imposed by the power network after the current has been broken. If this breakdown takes place between the instant corresponding to breaking of the current and the end of a quarter cycle of the power network voltage imposed on the circuit-breaker after the instant of breaking, it causes reactivation of the circuit-breaker. Such reactivation does not produce a voltage surge in the power network, but can involve damage to the insulators, for example the insulator that is used for the nozzle of the circuit-breaker.

If the breakdown takes place later than one quarter cycle of the network voltage imposed on the circuit-breaker after the instant of breaking the current, then the breakdown will cause restarting of the circuit-breaker, thereby giving rise to an excessive surge in the power network, which can involve serious damage to apparatus connected to the network. Such reactivation is therefore prohibited in tests of the kind prescribed by international standards.

DISCLOSURE OF THE INVENTION

Thus there is a need to propose an interrupting chamber, for use in particular in a power circuit-breaker, which enables both strong and weak currents to be broken while avoiding the need for pointless increase in the consumption of energy from outside by the circuit-breaker, whatever the arcing time may be, and which also optimizes the breaking of capacitive currents.

To that end, one embodiment proposes a current interrupting chamber, for use in a circuit-breaker and filled with a dielectric fluid. The chamber includes a moving assembly that is axially displaceable between a start position and an end position of an operation of opening the circuit-breaker.

The moving assembly further comprises at least one first compression chamber, of volume that diminishes between the start position of an operation of opening the circuit-breaker and a position corresponding to the completion of the compression process in the first compression chamber.

The moving assembly further includes a hollow drive tube having at one end at least one first arcing contact adapted to cooperate with a second arcing contact, and further having ports for bringing the interior of the drive tube into communication with the outside of the current interrupting chamber, the interior of the drive tube being in communication with the first compression chamber between a position corresponding to the separation of the two arcing contacts and the end position of an operation of opening the circuit-breaker.

The moving assembly also includes a second compression chamber, which is in communication at a first end thereof with the first compression chamber, and the volume of which diminishes between the position corresponding to the separation of the contacts and the end position of an operation of opening the circuit-breaker, the second compression chamber being adapted to inject dielectric fluid into the first compression chamber between the position corresponding to the separation of the two arcing contacts and the end position of an operation of opening the circuit-breaker, when the pressure in the first compression chamber is lower than the pressure in the second compression chamber.

The moving assembly further includes means for obstructing the ports in the drive tube as from the start position of an operation of opening the circuit-breaker and up to an intermediate position which is attained between the position corresponding to the separation of the two arcing contacts and the end position of an operation of opening the circuit-breaker.

In this current interrupting chamber, the position corresponding to the completion of the compression process in the first compression chamber is attained before the end position of an operation of opening the circuit-breaker, and a position corresponding to the completion of the compression process in the second compression chamber is attained after the position corresponding to the completion of the compression process in the first compression chamber.

During an operation of breaking a high current, the cooperation between the two compression chambers enables the advantages of a reduced compression stroke performed by the first compression chamber to be conserved, while in an operation of breaking a weak current, it enables breaking of the current to take place without any pointless increase in the consumption of energy from outside by the circuit-breaker, regardless of arcing time and in particular when the arcing time is long.

In this regard, where the current is weak and arcing time long, the second compression chamber enables blow-out of the arc to be maintained, this being done at first by the first compression chamber and continuing during the whole arcing time, so avoiding excessive consumption of energy from outside because of the use of the energy supplied by the arc during the whole period of the blow-out.

The current interrupting chamber may include a first compression volume which becomes a thermal expansion volume serving for blowing out the arc when the compression taking place in this volume ends, and it can also include a second compression volume. The first compression chamber may be rapidly put into over-pressure by making use of the displacement of the arcing contacts during only a first part of the total stroke of the moving assembly. Compression in the first chamber is therefore carried out during a reduced compression stroke, enabling a rapid pressure increase to take place, and giving blow-out performance greater than that of devices in which compression is performed over the whole stroke. The second compression chamber then comes into action if need be, so as to contribute to the blow-out at the end of the movement performed by the arcing contacts.

The fact that compression is first obtained in the first chamber, and then in the second chamber, which has a piston cross section that is smaller than that of the first chamber, and in which the maximum over-pressure is achieved at the end of the movement of the contacts, enables the energy used in the operation of the interrupting chamber to be reduced.

In this way, the use of this interrupting chamber in a circuit-breaker makes it possible, for example, to use drive members that comprise a spring mechanism calling for little energy.

In addition, the means for obstructing the apertures in the drive tube, as from the position of the start of the operation of opening the circuit-breaker and up to an intermediate position which is reached between a position corresponding to separation of the two arcing contacts and the position of the end of an operation of opening the circuit-breaker, or between the position corresponding to separation of the two arcing contacts and a position corresponding to the opening of the first compression chamber, obtained by separating one of the arcing contacts from a nozzle (this arcing contact and the nozzle being in cooperation so as to close off the first compression chamber at one of its ends), enable the volume in the drive tube to be put under over-pressure at the same time as the first compression chamber and before separation of the arcing contacts, and also enable this over-pressure to be substantially preserved for a few milliseconds after separation of the contacts, so as therefore to maintain a high gas density between the arcing contacts over the critical period during which an electrical breakdown may occur between the arcing contacts, all this occurring regardless of the arcing time. This increase in gas density thus prevents the occurrence of such an electrical breakdown. The obstruction of the ports formed in the drive tube enables a blow-out to be avoided through the ports during the critical period.

The above is applicable especially where breaking of capacitive currents is particularly critical, that is to say when it is carried out with a minimum of arcing time, for example an arcing which is equal to or less than about 1 ms, because the arcing contacts are then at their closest to each other when the restored voltage reaches its maximum value (for example 10 ms after the instant of breaking of the current for a network at 50 hertz (Hz)), thereby increasing the risk of dielectric shock. The high dielectric gas density in the first chamber and in the drive tube reduces this risk.

When the ports are no longer obstructed, they bring the interior of the drive tube into communication with the outside of the current interrupting chamber, and full extinguishing is then restored for breaking high currents.

The dimensions and positioning of the means for obstructing the ports relative to the drive tube may be such that the intermediate position is attained after a period of time lying in the range about 2 ms to about 7 ms after the position corresponding to the separation of the two arcing contacts. After this time, the arcing contacts may be quite far apart from each other, thereby eliminating the danger that an electrical breakdown will occur between the arcing contacts.

The means for obstructing the ports of the drive tube may include at least one deflector which is disposed inside the drive tube.

The deflector may be movable relative to the drive tube.

The first compression chamber may comprise at least one first tubular element.

The second compression chamber may comprise at least two coaxial second tubular elements. One of the two second tubular elements may partly constitute the drive tube.

The second compression chamber may then be closed at a second end thereof by at least one sleeve which is disposed between the two coaxial second tubular elements. The means for obstructing the ports in the drive tube may comprise the sleeve.

The drive tube may be movable relative to the sleeve.

The first compression chamber may include at one end thereof a nozzle which is adapted to cooperate with the second arcing contact, for realize an opening of the first compression chamber between said intermediate position and the end position of an operation of opening the circuit-breaker.

The second compression chamber may be in communication with the first compression chamber through at least one valve.

The first and second arcing contacts may be movable axially relative to each other.

Another embodiment provides a circuit-breaker that includes a current interrupting chamber as set forth above.

BRIEF DESCRIPTION OF THE DRAWINGS

The present invention can be understood more clearly on a reading of the description of embodiments, which is given by way of example only and which is in no way limiting, with reference to the attached drawings, in which.

Parts that are identical, similar, or equivalent to one another in the various figures described below carry the same reference numerals so as to facilitate going from one figure to another.

Figure 1:
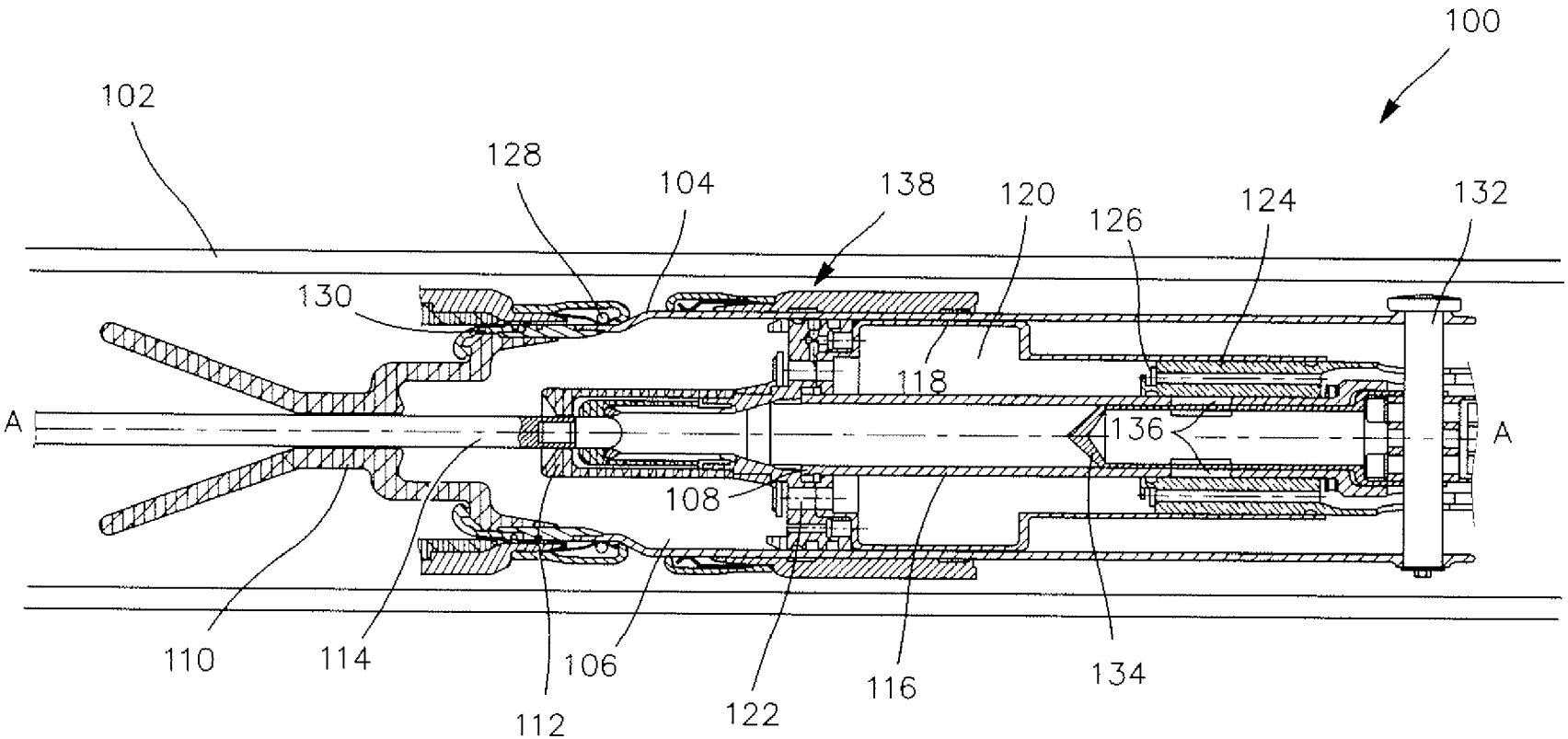
FIGS. 1 to 5 show a current interrupting chamber in one particular embodiment, in the course of various steps in an operation of opening the circuit-breaker.

The various parts shown in the drawings are not necessarily drawn to a uniform scales to render the drawings easier to read.

The various possibilities (i.e. different variants and embodiments) are to be understood not to be exclusive of each other, and may be combined together.

DETAILED DESCRIPTION OF PARTICULAR EMBODIMENTS

FIG. 1 shows a current interrupting chamber 100 in one particular embodiment. In this figure, the interrupting chamber 100 is in its engaged position, that is to say in a position in which the interrupting chamber 100 is at the start of a current breaking operation, that is to say at the start of an operation of opening the circuit-breaker that includes the interrupting chamber 100.

The interrupting chamber 100 has a casing 102 filled with a dielectric fluid, here a dielectric gas, under pressure. This gas may for example be sulfur hexafluoride ($SF_6$), nitrogen ($N_2$), dry air, carbon dioxide gas ($CO_2$), or a mixture of gases.

The interrupting chamber 100 includes a first tubular element 104 which constitutes a first compression chamber 106. This first compression chamber 106 is, in particular, closed at a first end by a drive tube 108. The first tubular element 104 defines a nozzle 110 in the region of a second end of the first compression chamber 106. The interrupting chamber 100 also has a first arcing contact and a second arcing contact, 112 and 114 respectively, which are movable relative to each other along an axis AA. In FIG. 1, the second arcing contact 114 is in cooperation with the nozzle 110 so as to close off the first compression chamber 106 at its second end. In the particular embodiment being described here, the first arcing contact 112 is movable and the second arcing contact 114 is fixed. The first arcing contact 112, which here is integral at one end with the drive tube 108, is disposed inside the first compression chamber 106.

The interrupting chamber 100 includes at least two second tubular elements 116 and 118, which are coaxial relative to the axis AA. One of the two second tubular elements, 116, partly constitutes the drive tube 108. The space between the two tubular elements 116 and 118 defines a second compression chamber 120. The volume of the second compression chamber 120 is typically smaller than that of the first compression chamber 106. In FIG. 1, the second compression chamber 120 is in communication with the first compression chamber 106 at a first end, through at least one valve 122, which is for example a one-way valve and which is incorporated in the drive tube 108. The valve 122 is only open when the pressure in the second compression chamber 120 is higher than that in the first compression chamber 106. The second compression chamber 120 is closed at a second end thereof by a sleeve 124, which includes a filling valve 126 that is used after the operation of opening the circuit-breaker, so that gas is able to enter the second compression chamber 120 when the interrupting chamber 100 reverts to its engaged position.

The interrupting chamber 100 further includes permanent contacts 128 and 130 which cause current to flow through the circuit-breaker when the interrupting chamber 100 is in its engaged position. Like the arcing contacts 112 and 114, the permanent contacts 128 and 130 are movable axially relative to each other along the axis AA. In the embodiment being described here, it is only the contact 130, incorporated in the first tubular element 104, that is movable.

The first tubular element 104 is connected to a rod 132, from which a means for operating the circuit-breaker, not shown in FIG. 1, is able to open the circuit-breaker. This rod 132 is fixed to a deflector 134 disposed inside the drive tube 108, and here inside the second tubular element 116, and it closes off the interior of the drive tube 108 at one of its ends, the other end being closed off by the arcing contacts 112 and 114. The deflector 134 is also movable, relative to the drive tube 108, along the axis AA.

Ports 136 are formed through the second tubular element 116, and put the interior of the drive tube 108 into communication with the rest of the casing 102. In FIG. 1, these ports 136 are obstructed by the deflector 134 and by the sleeve 124.

The first tubular element 104, the drive tube 108, the second tubular elements 116 and 118, the rod 132, and the deflector 134 constitute together a moving assembly 138 which is adapted to be displaced along the axis AA within the casing 2 during an operation of opening the circuit-breaker, or current breaking operation.

Figure 2:
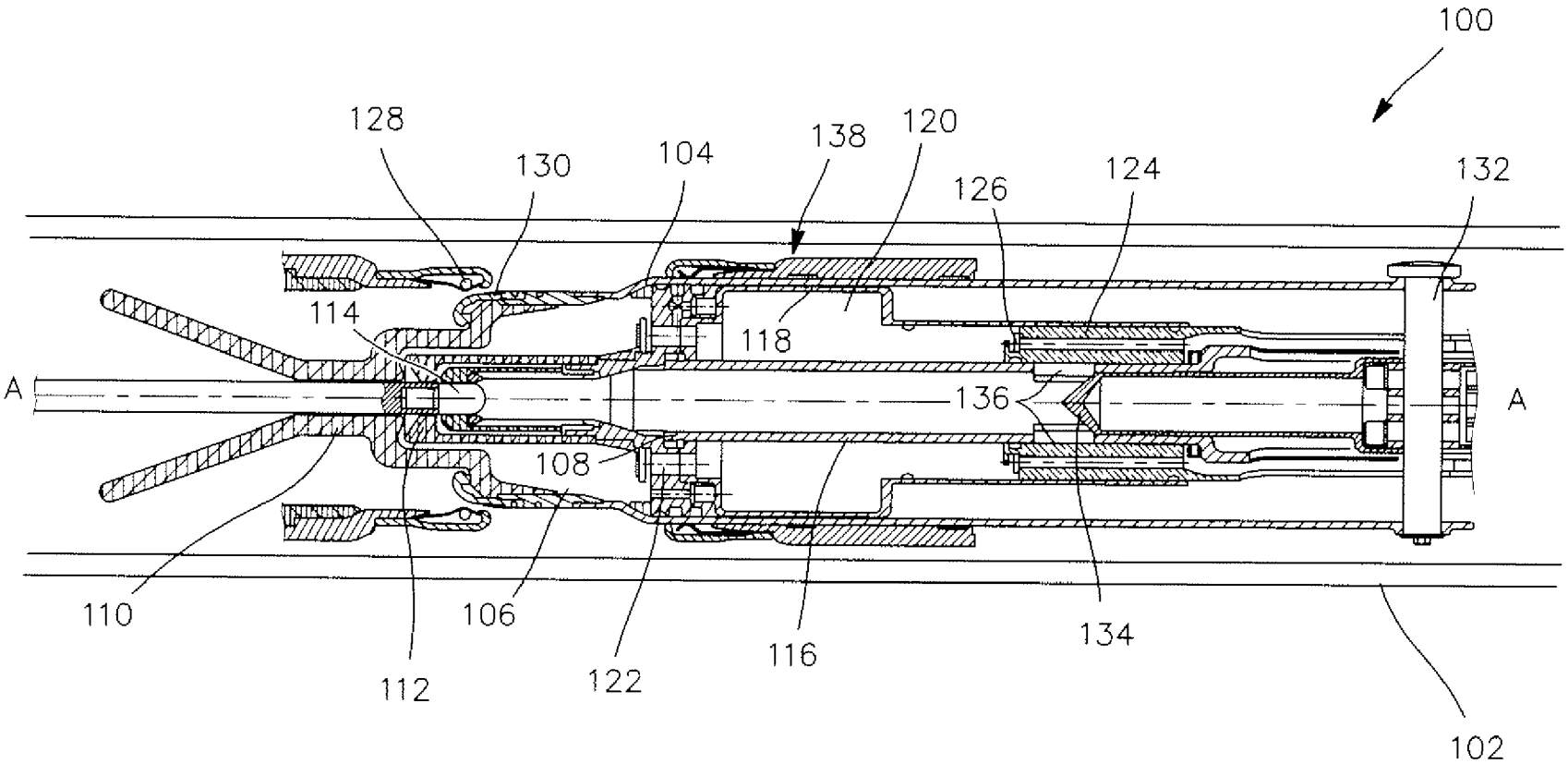

FIG. 2 shows the interrupting chamber 100 in the position corresponding to the end of compression in the first compression chamber 106. In this position, as distinct from the engaged position shown in FIG. 1, the first tubular element 104, the rod 132 and deflector 134 have been displaced along the axis AA by operating means, not shown, coupled to the rod 132.

The displacement of the first tubular element 104 here reduces the volume of the first compression chamber 106, because the drive tube 108 and the second tubular elements 116 and 118 remain stationary, thereby increasing the pressure inside the first compression chamber 106. In order to immobilize the drive tube, metal balls may be used as in FIG. 2A of the document FR 2 892 851; however, other means are possible.

In general, the stroke of the axial displacement performed during this part of the operation of opening the circuit-breaker represents between about one third and one half of the total axial stroke in an operation of opening the circuit-breaker.

In FIG. 2, the permanent contacts 128 and 130 are no longer in contact with each other, by contrast with the arcing contacts 112 and 114, which are still in contact with each other. Therefore, in the position corresponding to the end of compression in the first compression chamber 106, current continues to pass only through the arcing contacts 112 and 114. The arcing contacts 112 and 114 therefore remain in contact with each other during the whole phase of compression in the first chamber 106.

In addition, during this part of the operation of opening the circuit-breaker, the deflector 134 has been displaced axially within the drive tube 108, here over a distance which is equivalent to that traveled by the first tubular element 104. In FIG. 2, the deflector 134 is no longer obstructing the ports 136. However, the ports 136 are still obstructed by the sleeve 124.

Figure 3:
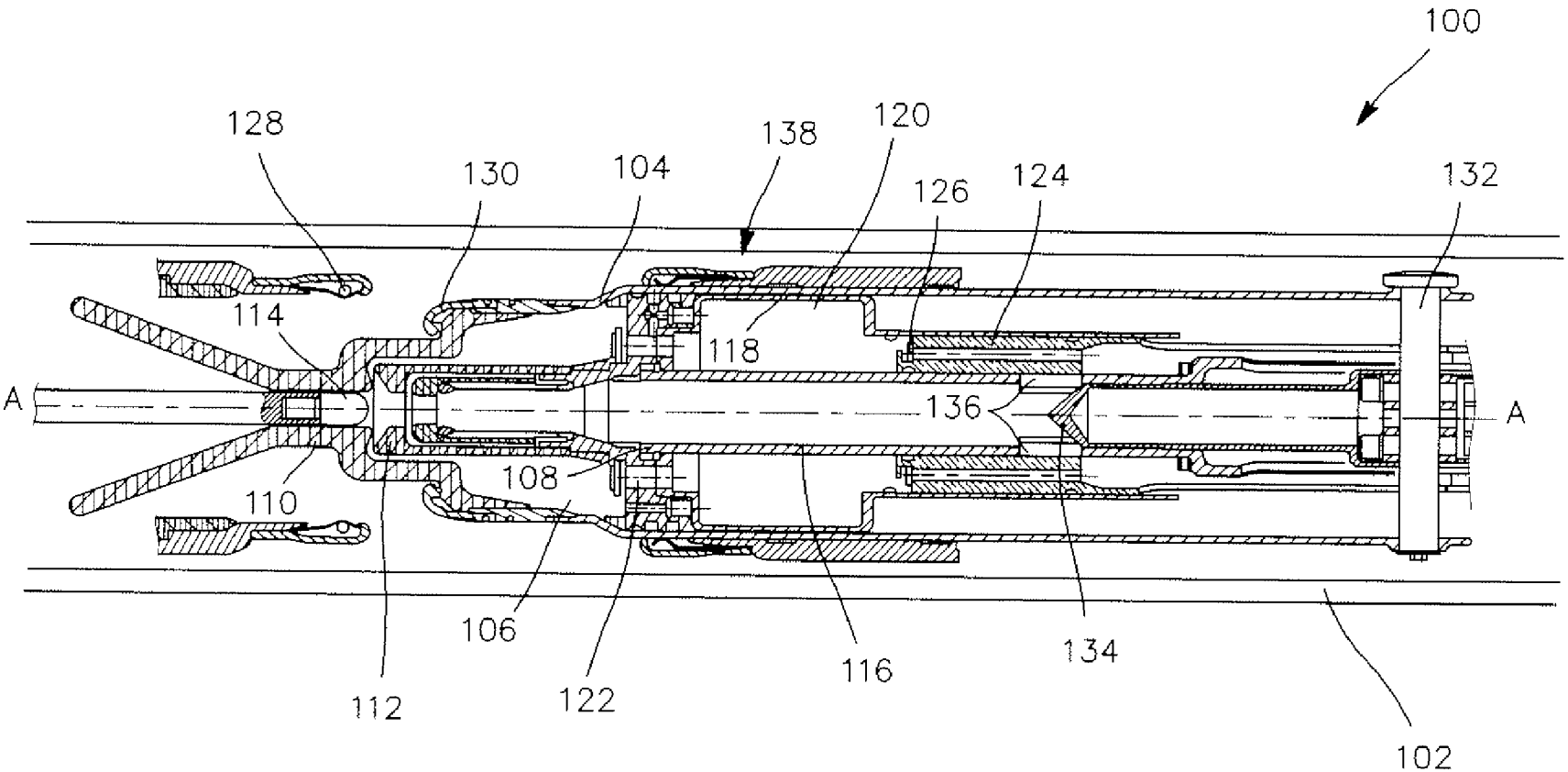

FIG. 3 shows the interrupting chamber 100 after separation of the arcing contacts 112 and 114 from each other. By contrast with the position corresponding to the end of compression in the first compression chamber 106, the moving assembly 138 is displaced along the axis AA relative to the fixed elements of the circuit-breaker, which are here the second arcing contact 114, the permanent contact 128, and the sleeve 124. In FIG. 3, the arcing contacts 112 and 114 are no longer in contact with each other. The drive tube 108 together with the second tubular elements 116 and 118 are driven in movement along the axis AA by the first tubular element 104.

In a current breaking operation, separation of the arcing contacts 112 and 114 from each other causes an arc to be set up between the two arcing contacts 112 and 114, and puts the volume of the first compression chamber 106 into communication with the volume within the drive tube 108. In this position, the ports 136 are obstructed by the sleeve 124 but no longer by the deflector 134. The volume defined by that of the first compression chamber 106 and that inside the drive tube is therefore closed at a first end by the deflector 134 and sleeve 124, while at a second end it is closed off by the second arcing contact 114 which is in cooperation with the nozzle 110. As compared with the position shown in FIG. 2, the volume of the second compression chamber 120 has also been reduced by the displacement of the tubular elements 116 and 118 relative to the sleeve 124, thereby increasing the pressure in the second chamber 120. Given that the compression operation in the first compression chamber 106 has been completed, and that compression of the gas is being effected only in the second chamber, the energy used for the displacement of the moving assembly 138 is less than that used for the compression that takes place in the first chamber 106.

When it is a capacitive current that is being broken, the value of which is for example less than about 100 A, then, given that the ports 136 are still obstructed by the sleeve 124, a high dielectric gas density is present in the first compression chamber 106 and in the drive tube 108. This high gas density prevents any electrical breakdown occurring between the arcing contacts 112 and 114. The obstruction of the ports 136 which is obtained here enables unnecessary blowing of gas through the interior of the drive tube 108 and through the ports 136 to be avoided, during a period in which the distance between contacts is not large enough for the breaking of high currents.

Figure 4:
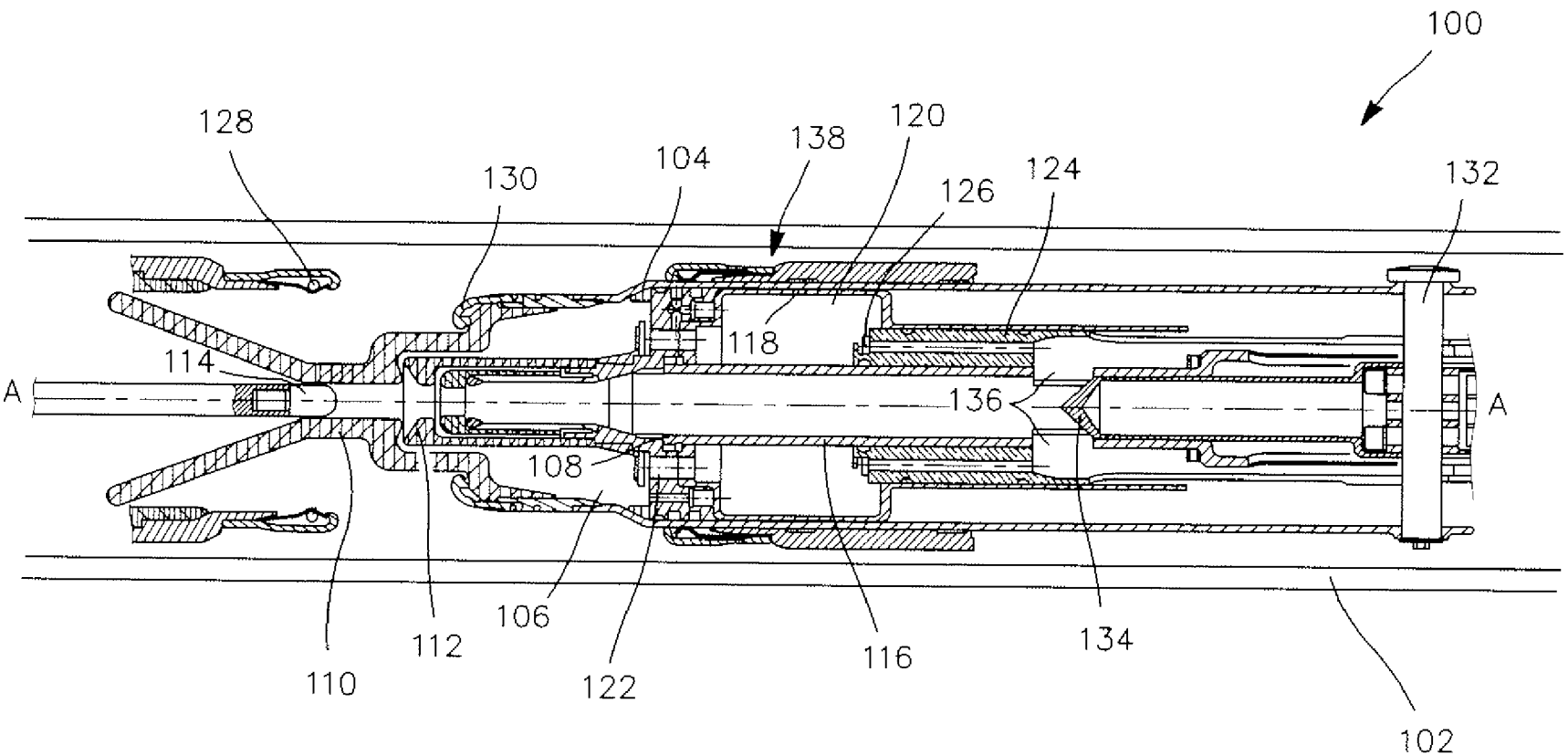

FIG. 4 shows an interrupting chamber 100 in a position in which the ports 136 are no longer obstructed. Thus, the volume defined by that of the first compression chamber 106 and the internal volume of the drive tube 108 is then still closed at its second end by the nozzle 110 and the second arcing contact 114, but it is open at its first end through the ports 136 which are no longer obstructed.

Thus, an intermediate position from which the ports 136 are no longer obstructed corresponds to a position reached between the position shown in FIG. 3 and that shown in FIG. 4, or between a position in which the arcing contacts become separated from each other and the end position of the operation of opening the circuit-breaker, or again between a position in which the arcing contacts become separated from each other and a position in which the first compression chamber 106 is opened by separation of the nozzle 110 and the second arcing contact 114 from each other.

The period of time corresponding to the passage from the position in which the two arcing contacts 112 and 114 become separated from each other and the intermediate position may be adjusted by the dimensions of the ports 136, the deflector 134 and the sleeve 124, and by the positioning of these elements relative to each other. This period of time can in particular be adjusted in such a way that it is included in the range about a quarter cycle and about a half cycle of a network voltage applied to the circuit-breaker after the position in which the two arcing contacts 112 and 114 become separated. For example, this time period is in the range about 5 ms to 10 ms for a network voltage having a frequency of 50 Hz, and lies in the range about 4.2 ms to 8.3 ms for a network voltage having a frequency of 60 Hz. The time period is preferably adjusted in such a way that it lies in the range about 2 ms to 7 ms after the position in which the two arcing contacts 112 and 114 become separated from each other. As to this, after the time period is ended, the ports 136 are no longer obstructed because the distance between the arcing contacts 112 and 114 is such that there no longer exists any danger of electrical breakdown between the arcing contacts 112 and 114 during an operation of breaking a capacitive current. This applies in particular where the breaking of the capacitive currents is particularly critical, that is to say where it is effected with minimum arcing time, for example an arcing time which is equal to or less than about 1 ms, because in this circumstance, after the arc has been broken, the arcing contacts are closest to each other for a given time period after breaking.

Figure 5:
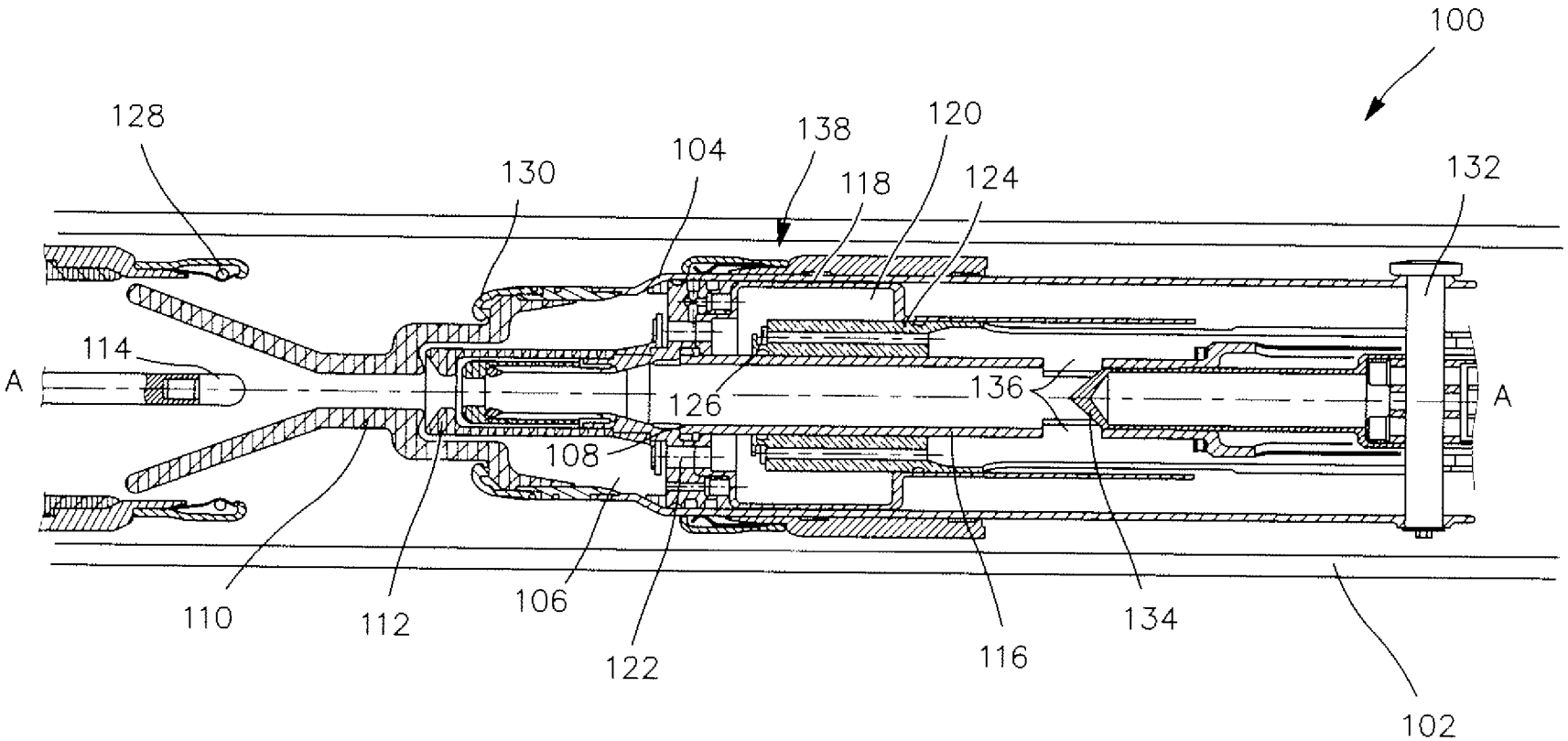

FIG. 5 shows the interrupting chamber 100 in the end position of the operation of opening the circuit-breaker, which is a position corresponding to the end of compression in the second compression chamber 120.

When breaking a fault current in short circuit, the blow-out of the arc occurs when the arcing contact 114 no longer cooperates with the nozzle 110 to close off the first compression chamber 106. In this regard, when the first compression chamber 106 opens in the region of the nozzle 110, the overpressure which is created in the first compression chamber 106 causes the volume of gas contained in the first chamber 106 to be blown towards the casing 102 through the nozzle 110.

If the arc is of short duration, the blow-out performed by the first compression chamber 106 is enough to extinguish the arc.

If the arc is of long duration, and if the value of the current is close to the fault value, the energy applied by the arc is sufficiently large for the blow-out created by the first compression chamber 106 to extinguish the arc.

By contrast, if the arc is of long duration and the value of current is weak, that is to say it is less than about 30% of the fault value, then the energy supplied by the arc is not enough for the blow-out created by the first compression chamber 106 to extinguish the arc. The arc is then still present after the gas present in the first chamber 106 has been decompressed. The pressure in the first compression chamber 106 is then less than that in the second compression chamber 120, which causes the valve 122 to open. Some gas is then blown out of the second compression chamber 120, and this blow-out continues until either the moving assembly 138 reaches the end of its stroke or the arc is extinguished.

It can be seen in FIG. 5 that a dead volume remains in which the compressed gas can be preserved, so that it can be caused to contribute to the blow-out when the pressure in the chamber 106 has diminished.

Figure 6:
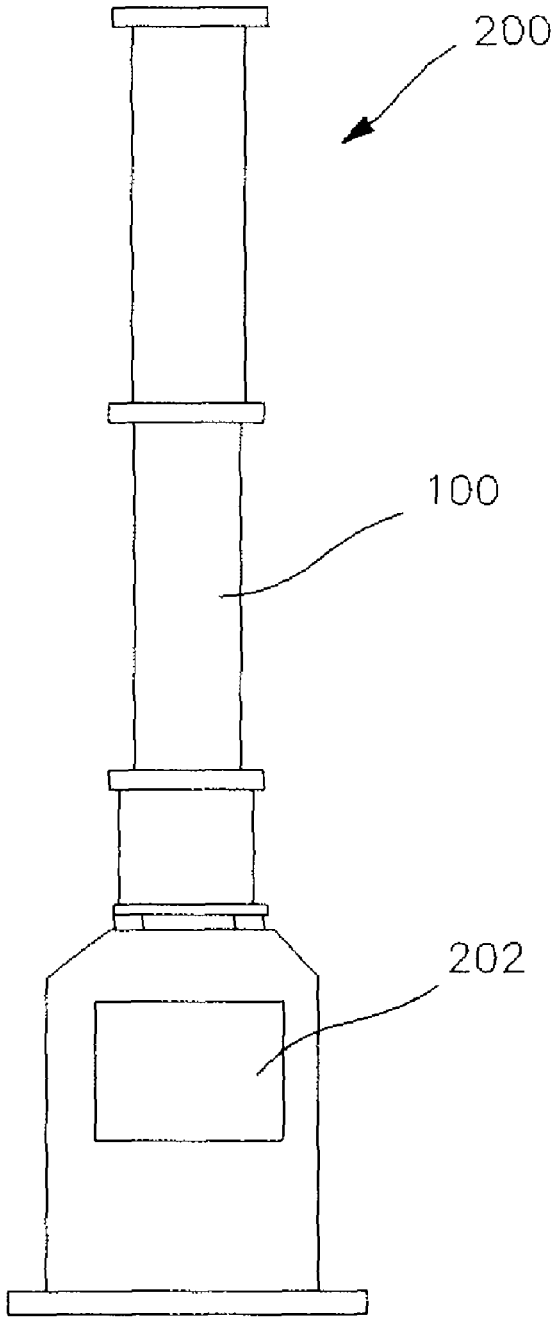
FIG. 6 shows a circuit-breaker, in one particular embodiment, which includes a current interrupting chamber.

The present invention further provides a circuit-breaker 200 shown in FIG. 6, which includes an interrupting chamber 100 of the kind described above. This circuit-breaker 200 is for example a power circuit-breaker for high or medium voltage, that is to say one which is used for voltages greater than about 52 kV. The interrupting chamber 100 is coupled to a drive member 202 which operates the compression in the interrupting chamber 100 and opening of the circuit-breaker 200.

Although several embodiments of the present invention have been described in detail, it should be understood that different variations and modifications may be applied without departing from the scope of the invention.

It is also possible to provide means that move the second arcing contact in a direction opposite to the displacement of the moving assembly during the operation of opening the circuit-breaker. The principle described is then applicable in the same way when both arcing contacts are movable.

The invention claimed is:

1. A current interrupting chamber, for use in a circuit-breaker and filled with a dielectric fluid, including:

a moving assembly which is axially displaceable between a start position and an end position of an operation of opening the circuit-breaker, the moving assembly comprising:

a) a first compression chamber, the volume of which diminishes between the start position of an operation of opening the circuit-breaker and a position corresponding to the completion of the compression process in the first compression chamber;

b) a hollow drive tube having at one end at least one first arcing contact adapted to cooperate with a second arcing contact, and further having ports for bringing the interior of the drive tube into communication with the outside of the current interrupting chamber, the interior of the drive tube being in communication with the first compression chamber between a position corresponding to the separation of the two arcing contacts and the end position of an operation of opening the circuit-breaker;

c) a second compression chamber, which is in communication at a first end thereof with the first compression chamber, and the volume of which diminishes between the start position and the end position of an operation of opening the circuit-breaker being adapted to inject dielectric fluid into the first compression chamber between the position corresponding to the separation of the two arcing contacts and the end position of an operation of opening the circuit-breaker, when the pressure in the first compression chamber is lower than the pressure in the second compression chamber; and d) means for obstructing the ports in the drive tube from the start position of an operation of opening the circuit-breaker up to an intermediate position which is attained between the position corresponding to the separation of the two arcing contacts and the end position of an operation of opening the circuit-breaker;

the position corresponding to the completion of the compression process in the first compression chamber being attained before the end position of an operation of opening the circuit-breaker, and a position corresponding to the completion of the compression process in the second compression chamber being attained after the position corresponding to the completion of the compression process in the first compression chamber.

2. The current interrupting chamber according to claim 1, wherein the dimensions and positioning of the means for obstructing the ports relative to the drive tube are such that the intermediate position is attained after a period of time lying in the range about 2 ms to 7 ms after the position corresponding to the separation of the two arcing contacts.

3. The current interrupting chamber according to claim 1, wherein the means for obstructing the ports of the drive tube include at least one deflector which is disposed inside the drive tube.

4. The current interrupting chamber according to claim 3, wherein the deflector is movable relative to the drive tube.

5. The current interrupting chamber according to claim 1, wherein the first compression chamber comprises at least one first tubular element.

6. The current interrupting chamber according to claim 1, wherein the second compression chamber comprises at least two coaxial second tubular elements, one of the two second tubular elements partly constituting the drive tube.

7. The current interrupting chamber according to claim 6, wherein the second compression chamber is closed at a second end thereof by at least one sleeve which is disposed between the two coaxial second tubular elements.

8. The current interrupting chamber according to claim 7, wherein the means for obstructing the ports in the drive tube comprise the sleeve.

9. The current interrupting chamber according to claim 7, wherein the drive tube is movable relative to the sleeve.

10. The current interrupting chamber according to claim 1, wherein the first compression chamber includes at one end thereof a nozzle which is adapted to cooperate with the second arcing contact, whereby to define an opening of the first compression chamber between said intermediate position and the end position of an operation of opening the circuit-breaker.

11. The current interrupting chamber according to claim 1, wherein the second compression chamber is in communication with the first compression chamber through at least one valve.

12. The current interrupting chamber according to claim 1, wherein the first and second arcing contacts are movable axially relative to each other.

13. A circuit-breaker including the current interrupting chamber according to claim 1.

* * * * *